US010378498B2

(12) United States Patent
Del Frate et al.

(10) Patent No.: US 10,378,498 B2
(45) Date of Patent: Aug. 13, 2019

(54) VALVE ASSEMBLY AND FLUID INJECTOR

(71) Applicant: CONTINENTAL AUTOMOTIVE GMBH, Hannover (DE)

(72) Inventors: Licia Del Frate, Lucca (IT); Carla Genise, Pisa (IT); Marco Maragliulo, Empoli / FI (IT); Francesco Sabatini, Pistoia (IT)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/485,856

(22) Filed: Apr. 12, 2017

(65) Prior Publication Data

US 2017/0218902 A1 Aug. 3, 2017

Related U.S. Application Data

(63) Continuation of application No. PCT/EP2015/068388, filed on Aug. 10, 2015.

(30) Foreign Application Priority Data

Oct. 15, 2014 (EP) ..... 14188946

(51) Int. Cl.
*F02M 51/06* (2006.01)
*F02M 61/16* (2006.01)
*F02M 61/20* (2006.01)

(52) U.S. Cl.
CPC .... *F02M 51/0682* (2013.01); *F02M 51/0671* (2013.01); *F02M 51/0685* (2013.01);
(Continued)

(58) Field of Classification Search
CPC ..... F02M 51/061; F02M 51/0657; F02M 51/066; F02M 51/0671; F02M 51/0682;
(Continued)

(56) References Cited

U.S. PATENT DOCUMENTS 6,520,434 B1 * 2/2003 Reiter ..... F02M 51/0685 239/533.11
2006/0192035 A1 * 8/2006 Petrone ..... F02M 51/0671 239/585.4

(Continued)

FOREIGN PATENT DOCUMENTS

CN 103261666 A 8/2013
DE 19927900 A1 12/2000

(Continued)

OTHER PUBLICATIONS

Korean Office Action dated Jun. 26, 2018 for corresponding Korean Patent Application No. 10-2017-7010301.

(Continued)

*Primary Examiner* — Darren W Gorman

(57) ABSTRACT

A valve assembly for a fluid injector is disclosed. The valve assembly includes a valve body having a longitudinal axis, an armature, a valve needle having a needle tip and a damping element. The armature and the damping element include penetrating first openings in which the valve needle is arranged. The damping element is fixed to the valve needle and arranged between the armature and the needle tip with respect to the longitudinal axis to attenuate a movement of the valve needle relative to the valve body during the operation of the valve assembly.

14 Claims, 3 Drawing Sheets

(52) U.S. Cl.
CPC ..... *F02M 61/16* (2013.01); *F02M 61/20* (2013.01); *F02M 2200/304* (2013.01); *F02M 2200/306* (2013.01)

(58) Field of Classification Search
CPC .... F02M 51/0685; F02M 61/16; F02M 61/20; F02M 2200/30; F02M 2200/304; F02M 2200/306
See application file for complete search history.

(56) References Cited

U.S. PATENT DOCUMENTS

| | | | | |
|---|---|---|---|---|
| 2008/0156906 | A1* | 7/2008 | Cagnolati | F02M 51/0614 239/585.1 |
| 2012/0318885 | A1* | 12/2012 | Grandi | F02M 51/066 239/5 |
| 2013/0327970 | A1 | 12/2013 | Pilgram | |
| 2014/0123946 | A1* | 5/2014 | Grandi | F02M 51/066 123/445 |
| 2014/0312147 | A1* | 10/2014 | Petrecchia | F02M 51/0621 239/585.5 |
| 2014/0353409 | A1 | 12/2014 | Kim et al. | |

FOREIGN PATENT DOCUMENTS

| | | | | |
|---|---|---|---|---|
| EP | 1595072 | A1 | 11/2005 | |
| EP | 2436908 | A1 | 4/2012 | |
| EP | 2634413 | A1 * | 9/2013 | F02M 51/066 |
| EP | 2949917 | A1 | 12/2015 | |
| JP | 2004518902 | A | 6/2004 | |
| WO | 2013085140 | A1 | 6/2013 | |
| WO | WO 2013167597 | A1 * | 11/2013 | F02M 51/0685 |
| WO | WO2013167597 | A1 | 11/2013 | |

OTHER PUBLICATIONS

International Search Report and Written Opinion dated Oct. 26, 2015 from corresponding International Patent Application No. PCT/EP2015/068388.

European Search Report and Written Opinion dated Apr. 1, 2015 from corresponding International Patent Application No. 14188946.9.

Chinese Office Action dated Sep. 29, 2018 for corresponding Chinese application No. 201580055695.6.

EP Examination Report dated Aug. 6, 2018 for counterpart EP application 14 188 946.9.

EP Examination Report dated Feb. 2, 2019 for counterpart EP application 14 188 946.9.

Korean Office Action dated Jan. 15, 2019 for counterpart KR application 10-2017-7010301.

Korean Office Action dated Mar. 15, 2019 for counterpart KR application 10-2017-7010301.

* cited by examiner

VALVE ASSEMBLY AND FLUID INJECTOR

CROSS REFERENCE TO RELATED APPLICATIONS

This U.S. patent application claims the benefit of PCT patent application No. PCT/EP2015/068388, filed Aug. 10, 2015, which claims the benefit of European patent application No. 14188946.9, filed Oct. 15, 2014, all of which are hereby incorporated by reference herein.

FIELD OF INVENTION

The invention relates to a valve assembly for a fluid injector and to a fluid injector.

BACKGROUND

Injectors are in widespread use, in particular for combustion engines where they may be arranged in order to dose a fluid into an intake manifold of the combustion engine or directly into a combustion chamber of a cylinder of the combustion engine.

In general, an injector has tough performance requirements to enable injection of accurate quantities of fluid and to fulfill pollution restrictions during operation of the injector and the corresponding combustion engine. Two main requirements are the ability to open at high pressures, for example higher than 200 bar in case of gasoline engines, and to enable fast closing times, for example less than 500 microseconds, in order to have a low flow and low actuation time.

Such requirements, for example also concern hydraulic valves like solenoid actuated valves. Regarding a solenoid injector, the mentioned requirements can be fulfilled using a free lift concept in which an armature, for example, travels a small portion of a total lift without carrying a valve needle. In a next step, the armature impacts the valve needle and opens the injector through an impulse that overcomes the necessary force to open the valve needle and the injector at high pressures and further allows for a fast opening transient.

Due to the impact of the armature on the valve needle, a velocity of the valve needle is high during opening and travel phases. On the one hand, the opening of the injector is desirable to be fast but on the other hand it is requested that a remaining portion of the impact on the valve needle leads to a limited velocity in order to make an operation of the valve needle and the injector controllable during ballistic operations, for example. In this context, a controllability of the injector refers to a variation of flow of a fluid versus changes of time of activation.

SUMMARY

One object of the invention is to create a valve assembly for a fluid injector which enables a reliable and secure functioning of the injector with particularly good controllability.

According to a first aspect, a valve assembly for a fluid injector is specified. According to a second aspect, a fluid injector comprising the valve assembly is specified. The fluid injector is, for example, a fuel injector for a combustion engine.

The valve assembly comprises a valve body, an armature, a valve needle having a needle tip and a damping element.

The valve body has a longitudinal axis and comprises a wall, i.e., in particular a circumferential side wall, which forms a recess that enables a streaming fluid to pass through the valve assembly during an operation. In particular, the recess is a fluid channel which extends axially through the valve body from a fluid inlet end to a fluid outlet end.

The armature and the damping element comprise penetrating first openings in which the valve needle is arranged. The respective first openings in particular extend axially through the armature and through the damping element.

Furthermore, the armature, the valve needle and the damping element are arranged axially movable in the recess with respect to the longitudinal axis and relatively to the valve body. The armature may be fixed to the valve needle or axially displaceable relative to the valve needle. In the latter case, the damping element is preferably operable to limit the axial displaceability of the armature relative to the valve needle in one axial direction. The valve needle may comprise an armature retainer for limiting the axial displaceability of the armature relative to the valve needle in the opposite axial direction. The armature retainer and the damping element may expediently be positioned on opposite axial sides of the armature.

In a mounted configuration, the damping element is connected to the valve needle. In particular, the damping element is fixed to the valve needle, for example to a shaft of the valve needle. The damping element is, for example, connected to the valve needle by press fit, by welding or machining. The damping element is preferably arranged between the armature and the needle tip of the valve needle with respect to the longitudinal axis to attenuate a movement of the valve needle relative to the valve body during operation of the assembly. In particular, the damping element is shaped and positioned to generate fluid friction when the valve needle moves relative to the fluid with which the recess is filled during operation of the valve assembly and the fluid injector.

Such a configuration of the assembly is a simple and reliable possibility to reduce a velocity of the valve needle at least temporary during an operation of the assembly. The damping element mounted on the valve needle decelerates the velocity of the valve needle due to enhanced flow resistance generated by the damping element and the streaming fluid. Hence, the deceleration is generated by a force which is induced by the velocity of the valve needle itself. The force may advantageously be dependent on the velocity of the movement of the valve needle, in particular the force increases with increasing needle velocity. Therefore, using the assembly enables a reliable and secure functioning of an injector with improved controllability. In particular, the needle movement may be self-stabilizing.

An absolute value of the decelerating force can be chosen by the configuration of the damping element, for example concerning a design or a shape of the damping element. Furthermore, the damping element may comprise one or more recesses or openings to vary the absolute value of the decelerating force.

According to one embodiment, the damping element substantially has the shape of a disc.

This embodiment of the invention describes one possible configuration of the damping element and realizes an appropriate flow resistance. For example, the disc shaped damping element may comprise a rectangular, oval or circular shape with respect to a top view in direction of the longitudinal axis. Thereby, a circular disc shape of the damping element is advantageous for manufacturing reasons because of its radial symmetrical shape. Expediently, the disc may have an outer circumferential side surface which has the same shape as an inner circumferential side surface of the wall of the valve body in the region which axially overlaps the disc.

According to a further embodiment, the damping element comprises at least one penetrating second opening to enable fluid to pass through the assembly during the operation. In one embodiment, the second opening or each of the second openings of the damping element has a central axis which is parallel and laterally offset to the longitudinal axis.

The described configuration of the damping element comprising one or more second openings depicts one way to vary the flow resistance and the decelerating force induced by the damping element and the streaming fluid. For example, the second openings are designed as five circular holes which penetrate the damping element and hence enable the fluid to pass through the damping element and the assembly during the operation. But there are also other embodiments of the damping element and the assembly that are possible which comprise a different number of second openings and, if necessary, second openings with different shapes.

According to a further embodiment, the armature comprises at least one penetrating second opening to enable the fluid to pass through the assembly during the operation. In one embodiment, the second opening or each of the second openings of the armature has a central axis which is inclined or skewed to the longitudinal axis.

One or more second openings which penetrate the armature enable further guiding of the streaming fluid and have an influence on the resulting flow resistance and the decelerating force generated by the damping element.

The positioning and design of the second openings of the damping element and/or the armature offer a variety of possibilities to adjust the decelerating force upon request to attenuate the movement of the valve needle during the operation of the assembly.

According to a further embodiment, an outlet aperture of the second opening of the armature does not overlap—or at most partially overlaps—an inlet aperture of the second opening of the damping element in top view along the longitudinal axis. In the case of a plurality of second openings of the armature and/or the damping element, each having a respective outlet aperture or inlet aperture, it is preferred that none of the outlet apertures completely overlaps with any of the inlet apertures. The outlet aperture(s) preferably overlaps, in particular completely overlaps, with the damping element in top view along the longitudinal axis. With advantage, the fluid stream may be guided in this way by the outlet apertures to impinge on the damping element and may be further guided laterally along the damping element by means of the relative positions of the outlet opening(s) and the inlet opening(s) so that a particular large fluid friction is achievable.

According to a further embodiment, a number of second openings of the damping element differs from a number of second openings of the armature. In the case that both the damping element and the armature comprise one or more second openings, it is advantageous that the respective numbers of the second openings differs from one another. In this way, the above-described non-overlapping configuration of the outlet openings and the inlet openings is easily achievable. Additionally, phasing and hydraulic sticking of the damping element and the armature may be avoided or reduced in this way.

If, for example, the armature comprises four second openings designed as penetrating channels whereas the damping element comprises three second openings designed as penetrating holes there is at least one channel which guides the fluid onto a surface of the damping element and not directly through the second opening of the damping element. Due to this part of streaming fluid, the damping element is pushed away from the armature and a hydraulic sticking of the armature and the damping element may be prevented or greatly reduced. Further embodiments of the assembly may comprise more second openings of the damping element than second openings of the armature.

According to a further embodiment, the valve needle comprises a penetrating opening to enable the fluid to pass through the assembly during the operation. The penetrating opening is in particular an axial channel. The axial channel extends, for example, at least through a portion of the shaft of the valve needle.

This configuration of the assembly describes another possibility to enable the fluid to pass through the assembly even in the case that the damping element and the armature do not comprise second openings. For example, if the armature and the damping element do not comprise second openings and nearly fill in the recess of the valve body in the radial direction, the opening of the valve needle defines a main fluid channel and the valve needle is configured as a hollow needle.

According to a further embodiment, the damping element substantially fills in the recess of the valve body in the radial direction, in particular to generate the fluid friction for attenuating the movement of the valve needle. For example, in a main plane of extension of the damping element, the damping element has an area which is 50% or more, preferably 75% or more, for example, 85% or more of that portion of the area of the recess in said main plane of extension which is not occupied by the valve needle.

This embodiment of the assembly and the damping element describes a possible shape of the damping element and influences the flow resistance and the decelerating force which attenuates the velocity and hence the motion of the valve needle during operation of the assembly. The damping element may have a particularly large flow resistance in this way. A main portion of the streaming fluid may then have to pass through the second openings of the armature and/or the damping element and/or through the opening of the valve needle to reach the needle tip.

According to a further embodiment, an outer circumferential outline of the damping element is arranged flush with an outer circumferential outline of the armature, in particular with respect to a radial direction perpendicular to the longitudinal axis. The outer circumferential outline of the damping element is in particular defined by its outer circumferential side surface. In this way, a particularly large fluid friction is achievable. For example, the lateral path of the fluid along the damping element may be particularly large.

According to a further embodiment, the damping element partially contacts the armature. In other words, the damping element has an upper surface and the armature has a lower surface which face towards each other and which are spaced apart from one another, apart from a region where the upper surface of the damping element has a protrusion which is engageable with the armature so that it enters into a form-fit connection with the lower surface of the armature. The protrusion is preferably in the basic shape of a ring, for example in the shape of a continuous ring which extends completely circumferentially around the longitudinal axis or in the shape of a plurality of ring segments which are circumferentially spaced apart from one another.

This configuration of the damping element in reference to the armature describes a possible contact surface between the damping element and the armature. With advantage, the contact surface is particularly small, and hydraulic sticking between the armature and the damping element is particularly small. At the same time, a good contact between the armature and the damping element can be established. The stability of the contact surface of the damping element is in particular sufficient to avoid damage due temporary contact between the armature and the damping element.

The protrusion may comprise a portion of the outer circumferential side surface of the damping element in one development. In this way, the risk of the armature and the damping element tilting relative to one another is particularly small.

For example, in the case of a disc shape of the damping element, the contact surface to the armature can be realized by a protrusion of the damping element that represents a slim ring, for example. In a longitudinal section view, the ring may have the shape of a nose.

BRIEF DESCRIPTION OF THE DRAWINGS

Exemplary embodiments of the invention are explained in the following with the aid of schematic drawings and reference numbers. Identical reference numbers designate elements or components with identical functions. In the figures.

DETAILED DESCRIPTION

Figure 1:
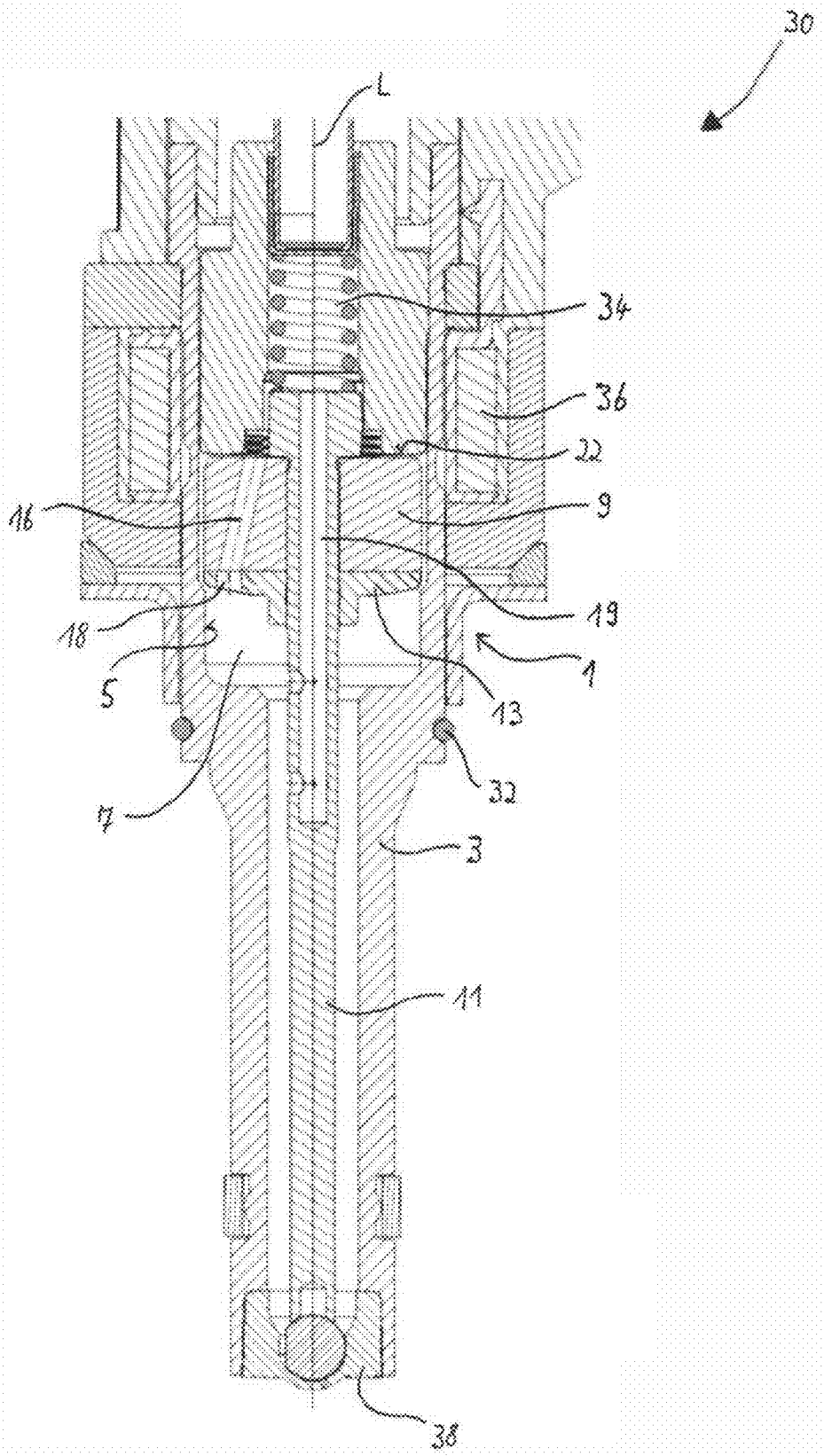
FIG. 1 shows an exemplary embodiment of a fluid injector.

FIG. 1 shows an exemplary embodiment of a fluid injector 30 which comprises an O-ring or a circlip 32 for locking a spacer ring to a valve body 3, a spring element 34 in the valve body 3 and a coil 36 in a housing which surrounds a portion of the valve body 3. The valve body 3 has a longitudinal axis L. The valve body 3 has a circumferential side wall 5 which defines a recess 7.

The injector 30 further comprises a valve needle 11 which is positioned in the recess 7. The valve needle 11 is connected to an armature 9 and is axially movable relative to the valve body 3 along the longitudinal axis L. In coaction with a nozzle 38, the valve needle 11 prevents a fluid flow through the injector 30 in a closed position and is axially displaceable away from the closed position to enable the fluid flow.

The valve needle 11 is displaced away from the closed position by means of a magnetic force generated by energizing the coil 36 and is displaced towards the closing position by means of an elastic force generated by the spring element 34. A hydraulic force generated by the streaming fluid also influences the opening and closing process during an operation of the injector 30, in particular when the valve needle 11 is close to the closing position. The valve needle 11 and the armature 9 are rigidly coupled or—as in the present embodiment—axially displaceable relative to one another. Specifically, the armature 9 is axially arranged between an armature retainer of the valve needle and a damping element 13 which is fixed to a shaft of the valve needle 11 so that it has an axial play. The armature 9, for example, is realized as a massive steel part from a magnetic steel.

A valve assembly 1 of the fluid injector 30 comprises the armature 9, the valve needle 11, the damping element 13 and the valve body 3. More detailed illustrations of the assembly 1 will be described below with respect to FIGS. 2 and 3.

Figure 2:
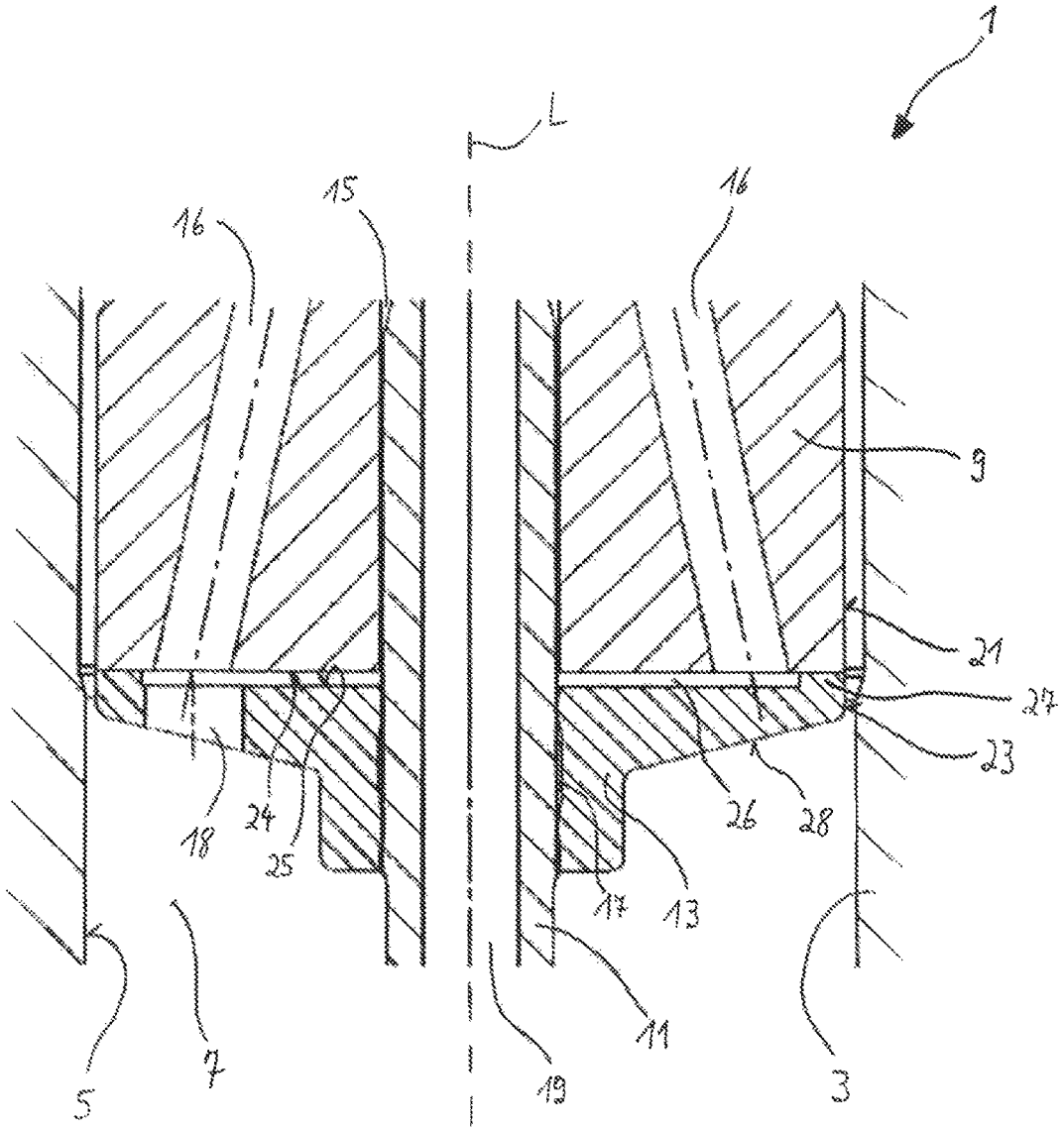
FIG. 2 shows an exemplary embodiment of an assembly for the fluid injector of FIG. 1.

In FIG. 2, one exemplary embodiment of the valve assembly 1 is illustrated wherein the armature 9, the damping element 13 and the valve needle 11 are arranged in the recess 7 of the valve body 3. The armature 9 further comprises a first opening 15 in which the valve needle 11 is arranged as well as the damping element 13 comprises a first opening 17 in which the valve needle 11 is arranged.

In this exemplary embodiment of the assembly 1, in a cross section view with respect to the longitudinal axis L, the armature 9 comprises two second openings 16 which penetrate the armature 9 axially from a first side—i.e., a lower surface 24 of the armature 9—to a second side—i.e., an upper surface 22 of the armature 9. A central axis of each of the second openings 16 is inclined to the longitudinal axis L.

The damping element 13 also comprises a second opening 18 which penetrates the damping element 13 from a first side—i.e., an upper surface 25 of the damping element 13—to a second side 28 of the damping element 13. A central axis of the second opening 18 is parallel to and radially offset from the longitudinal axis L so that the second opening 18 is radially spaced apart from the longitudinal axis L.

In this exemplary embodiment, the valve needle 11 also comprises an opening 19 which extends axially through a portion of the valve needle 11 and thus the valve needle 11 acts as a hollow needle to enable fluid to pass through the assembly 1 during the operation of the assembly 1 or the injector 30. Such a configuration of the valve needle 11 is advantageous if, for example, the damping element 13 comprises no second openings 18 to let streaming fluid pass through. Alternatively, the streaming fluid can flow outside the armature 9 and the damping element 13 if there is enough clearance left to the wall 5 of the valve body 3.

This exemplary embodiment describes a combination of the armature 9, the valve needle 11 and the damping element 13 each comprising penetrating openings 16, 18, and 19, respectively, to enable fluid to pass through the assembly 1 during the operation. Concerning further embodiments, there may only be second openings 16 and 18 of the armature 9 and the damping element 13, respectively, arranged whereas the valve needle 11 is substantially solid. Alternatively, there is only one or more second openings 16 arranged which penetrate the armature 9 whereas the valve needle 11 and the damping element 13 are substantially configured solidly. Hence, various combinations of the armature 9, the valve needle 11 and the damping element 13 are possible which do or do not comprise penetrating openings 16, 18, 19, respectively, to enable streaming fluid to pass through the assembly 1.

Furthermore, the damping element 13 comprises a shape of a disc and is fixedly mounted on the valve needle 11, for example by press fit, welding or machining. The damping element 13 further matches the armature 9 concerning a lateral dimension of these components. This means that in this embodiment, an outer outline of a circumferential side surface 21 of the armature 9 is flush with an outer outline of a circumferential side surface 23 of the damping element 13 in top view along the longitudinal axis L. In addition, the damping element 13 nearly fills the recess 7 of the valve body 3 in a radial direction substantially perpendicular with respect to the longitudinal axis L. Preferably, only a small circumferential gap having a width—i.e., a radial dimension—of 0.5 mm or less, preferably of 0.2 mm or less, is established between the outer side surface 23 of the damping element 13 and an inner surface of the wall 5 of the valve body 3. Such gap sizes are also useful for other embodiments of the valve assembly 1.

The upper surface 25 of the damping element 13 has a ring-shaped protrusion 27 which is engageable into a form-fit connection with the bottom surface 24 of the armature 9. When the protrusion 27 is in contact with the bottom surface 24 of the armature 9, the rest of the upper surface 25 of the damping element 13 is spaced apart from the bottom surface 24 of the armature 9 so that a gap 26 is established between the two surfaces 24, 25 in a region radially inward of the ring-shaped protrusion 27. The protrusion 27 realizes a small contact surface to the armature 9 in a shape of a slim ring. For example, in a closed position of the injector 30, the protrusion 27 of the damping element 13 contacts the bottom surface 24 of the armature 9. In this context, it is desirable that the contact surface is small enough to avoid hydraulic sticking of the armature 9 and the damping element 13, but big enough to enable sufficient stability of the contact surface of the damping element 13 to avoid damage due temporary contact between the armature 9 and the damping element 13.

In case of an opening transient, the armature 9 moves upwards with respect to the longitudinal axis L, i.e., away from the damping element 13 due to the magnetic force generated by the coil 36. For example, after a preferred free lift of the armature 9, the valve needle 11 and the connected damping element 13 are also moved upwards due to the impact of the armature 9 on the armature retainer. Thus, the valve needle 11 is displaced away from the closing position and the streaming fluid mainly passes through the openings 16, 18 and 19.

Regarding this exemplary embodiment, the armature 9 comprises two second opening 16 whereas the damping element 13 comprises one second opening 18. It is advantageous that the respective number of the second openings 16, 18 differs from one another, for example, to further avoid phasing and hydraulic sticking of the damping element 13 and the armature 9. For example, the two second openings 16 of the armature 9 are designed as penetrating channels and the one second opening 18 of the damping element 13 is designed as a penetrating hole. Hence, there is at least one channel which guides the fluid into the recessed area 26 and onto the upper surface 25 of the damping element 13 and not directly through the second opening 18. Due to this part of streaming fluid impacting on the upper surface 25 of the damping element 13 and being deflected in a lateral direction, fluid friction may be generated and/or the damping element 13 may be pushed away from the armature 9 so that a hydraulic sticking of the armature 9 and the damping element 13 is prevented.

The assembly 1 describes a simple, reliable and competitive possibility to reduce a velocity of the valve needle 11 during an operation of the assembly 1 in reference to an opening process of the injector 30, for example. The damping element 13 mounted on the valve needle 11 decelerates the velocity of the valve needle 11 due to enhanced flow resistance generated by the damping element 13 and the streaming fluid. Hence, the deceleration is generated by a force which is induced by the velocity of the valve needle 11 itself. Therefore, using the assembly 1 enables a reliable and secure functioning of the injector 30 with improved controllability.

An absolute value of the decelerating force can be chosen by the configuration of the damping element 13, for example, concerning a design or a shape of the damping element 13. Furthermore, the damping element 13 may comprise one or more recesses or openings like the described second openings 18 to adjust the absolute value of the decelerating force. The damping element 13 is connected to the valve needle 11. It may reduce the velocity of the valve needle 11 during the opening and the closing transient. The injector 30 which comprises the valve assembly 1 exhibits an improved controllability in a ballistic phase of the opening transient or in a ballistic operation mode where the valve needle 11 returns to the closing position without hitting a hard stop at the end of the opening transient. Hence, such a configuration allows for a fast opening of the injector 30 also at high pressure combined with an enhanced controllability of the valve needle 11 and the functioning of the injector 30 which is advantageous to accurately dose the fluid, for example.

Figure 3:
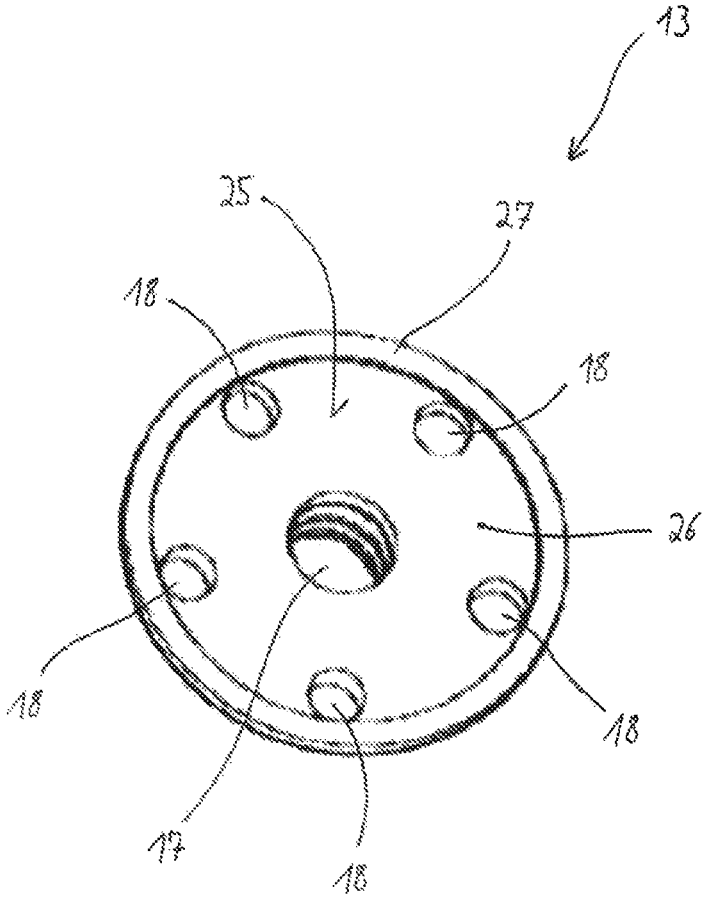
FIG. 3 shows an exemplary embodiment of a damping element depicted in FIGS. 1 and 2.

FIG. 3 shows an exemplary embodiment of the damping element 13 which is similar to the one illustrated in FIG. 2. The damping element 13 comprises five penetrating second openings 18 with circular shape which are arranged on a circle around the first penetrating opening 17 with respect to the longitudinal axis L. The second openings 18 have a smaller diameter than the first opening 17 which is arranged for assembling the valve needle 11 and which, for example, matches a diameter of the adjacent first opening 15 of the armature 9. In this perspective view, the contact surface between the damping element 13 and the armature 9 given by the protrusion 27 of the damping element 13 is apparent. This also concerns the upper surface 25 and its recessed area radially inward from the protrusion 27, which recessed area shapes the gap 26 between the damping element 13 and the armature 9.

Additionally, the damping element 13 enables a stabilisation effect by guiding the valve needle 11 in reference to the armature 9 with respect to the longitudinal axis L. This is in particular affected by the outer circumferential side surface 23 of the damping element 13 being in sliding contact with the wall 5 of the valve body 9. In this context, a large diameter of the disc shaped damping element 13 is advantageous because this enables a beneficial starting position of the connected valve needle 11 with respect to the armature 9 due to leverage induced by the contact surface between the protrusion 27 of the damping element 13 and the first side 24 of the armature 9. To enable the above mentioned guiding effect, the damping element 13 of this embodiment comprise a small contact surface to the armature 9 and nearly fills in the recess 7 of the valve body 3, e.g., to realize an advantageous leverage.

The foregoing description illustrates various aspects and examples of the invention. It is not intended to be exhaustive. Rather, it is chosen to illustrate the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A valve assembly for a fluid injector comprising:

a valve body having a longitudinal axis and comprising a wall which forms a recess that enables a streaming fluid to pass through the assembly during an operation, an armature, a valve needle having a needle tip, and a damping element, wherein the armature and the damping element comprise penetrating first openings, in which the valve needle is arranged, the armature, the valve needle and the damping element are arranged axially movable in the recess with respect to the longitudinal axis and relative to the valve body, and the damping element is fixed to the valve needle and arranged between the armature and the needle tip with respect to the longitudinal axis to attenuate a movement of the valve needle relative to the valve body during the operation of the assembly, wherein the damping element comprises at least one penetrating second opening to enable the fluid to pass through the valve assembly during the operation, and the armature comprises at least one penetrating second opening to enable the fluid to pass through the valve assembly during the operation.

2. The valve assembly according to claim 1, wherein the damping element substantially fills in the recess of the valve body in a radial direction to generate a fluid friction for attenuating the movement of the valve needle.

3. The valve assembly according to claim 1, wherein an outer circumferential outline of the damping element is arranged flush with an outer circumferential outline of the armature.

4. The valve assembly according to claim 1, wherein the damping element has an upper surface and the armature has a lower surface which face towards each other and which are spaced apart from one another apart from a region where the upper surface of the damping element has a substantially ring-shaped protrusion which is engageable with the armature so that the protrusion enters into a form-fit connection with the lower surface of the armature.

5. The valve assembly according to claim 1, wherein an outlet aperture of the at least one second opening of the armature no more than partially overlaps an inlet aperture of the at least one second opening of the damping element from a top view along the longitudinal axis.

6. The valve assembly according to claim 5, wherein a number of second openings of the damping element differs from a number of second openings of the armature.

7. The valve assembly according to claim 1, wherein the valve needle comprises an axial channel to enable the fluid passing the assembly during the operation.

8. The valve assembly according to claim 1, wherein the damping element has the shape of a disc.

9. The valve assembly according to claim 1, wherein the valve assembly forms part of the fluid injector.

10. A valve assembly for a fluid injector, comprising:

a valve body having a longitudinal axis and including a wall which forms a recess that enables fluid to flow through the assembly during an operation of the fluid injector;

an armature;

a valve needle having a needle tip; and a damping element;

wherein each of the armature and the damping element includes a first opening through which the valve needle is arranged, wherein the armature, the valve needle and the damping element are axially movable in the recess with respect to the longitudinal axis and relative to the valve body, wherein the damping element is fixed to the valve needle and arranged between the armature and the needle tip with respect to the longitudinal axis to attenuate a movement of the valve needle relative to the valve body during the operation of the assembly, and wherein the damping element comprises at least one second opening defined through the damping element, the at least one second opening enabling the fluid to flow through the valve assembly during the operation, and the armature comprises at least one second opening defined through the armature, the at least one second opening enabling the fluid to flow through the valve assembly during the operation.

11. The valve assembly of claim 10, wherein the damping element has an upper surface and the armature has a lower surface which faces the upper surface of the damping element, a first portion of the upper surface and a first portion of the lower surface are spaced apart from one another, the damping element further including a protrusion disposed radially outwardly from the first portion of the upper surface, the protrusion is engageable with the lower surface of the armature so that the protrusion enters into a form-fit connection therewith.

12. The valve assembly according to claim 10, wherein a number of the second openings of the armature is different from a number of the second openings of the damping element.

13. The valve assembly according to claim 12, wherein the number of the second openings of the armature is greater than the number of the second openings of the damping element such that during at least a portion of the operation, a first fluid flow path through the valve assembly is defined in a direction that is lateral to the longitudinal axis in a space between an upper surface of the damping element and a lower surface of the armature.

14. The valve assembly according to claim 10, wherein the at least one second opening of the armature no more than partially overlaps the at least one second opening of the damping element.

* * * * *